US010808396B2

(12) United States Patent
Zhang et al.

(10) Patent No.: US 10,808,396 B2
(45) Date of Patent: Oct. 20, 2020

(54) BUILDING BASED ON LARGE-SPACE STRUCTURE AND FREESTANDING EXTERNAL ENVELOPE AS WELL AS CONSTRUCTION METHOD

(71) Applicant: SOUTHEAST UNIVERSITY, Nanjing (CN)

(72) Inventors: Hong Zhang, Nanjing (CN); Junjun Zhang, Nanjing (CN); Meng Cong, Nanjing (CN); Jianing Luo, Nanjing (CN); Cong Liu, Nanjing (CN); Jiang Yin, Nanjing (CN); Shihu Feng, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 187 days.

(21) Appl. No.: 16/308,369

(22) PCT Filed: Jun. 16, 2017

(86) PCT No.: PCT/CN2017/088660
§ 371 (c)(1),
(2) Date: Dec. 7, 2018

(87) PCT Pub. No.: WO2017/219920
PCT Pub. Date: Dec. 28, 2017

(65) Prior Publication Data

US 2019/0257094 A1 Aug. 22, 2019

(30) Foreign Application Priority Data

Jun. 24, 2016 (CN) ..... 2016 1 0475800

(51) Int. Cl.
*E04F 17/08* (2006.01)
*E04B 1/34* (2006.01)
(Continued)

(52) U.S. Cl.
CPC ..... *E04B 1/342* (2013.01); *E04B 2/86* (2013.01); *E04B 5/32* (2013.01); *E04C 3/20* (2013.01);
(Continued)

(58) Field of Classification Search
CPC ..... E04F 13/074; E04F 17/02; E04F 17/023; E04F 17/08; E04B 1/161; E04B 1/215;
(Continued)

(56) References Cited

U.S. PATENT DOCUMENTS 9,388,561 B2 * 7/2016 Johnson ..... B28B 1/14

FOREIGN PATENT DOCUMENTS

CN 102852223 A * 1/2013
CN 103806659 A * 5/2014
(Continued)

*Primary Examiner* — Ryan D Kwiecinski
(74) *Attorney, Agent, or Firm* — CBM Patent Consulting, LLC

(57) ABSTRACT

A building based on a large-space structure body and a freestanding external envelope structure and a construction method, wherein the building comprises a structure body composed of a vertical-structure reinforced concrete member, a reinforced concrete girder and a reinforced concrete slab, and a freestanding combined external envelope system externally hung in a periphery of the structure body; and the structure body is made of a prefabricated combined reinforcement cage member poured with concrete, the prefabricated combined reinforcement cage member is combined and assembled by a prefabricated vertical-structure reinforcement cage member, a prefabricated girder reinforcement cage member and a prefabricated slab reinforcement cage member, and the prefabricated vertical-structure reinforcement cage member is a prefabricated shear wall reinforcement cage member or a prefabricated column reinforcement cage member.

10 Claims, 14 Drawing Sheets

(51) Int. Cl.

| | |
|---|---|
| ***E04B 2/86*** | (2006.01) |
| ***E04B 5/32*** | (2006.01) |
| ***E04C 3/20*** | (2006.01) |
| ***E04C 5/06*** | (2006.01) |
| ***E04B 1/342*** | (2006.01) |
| ***E04C 3/34*** | (2006.01) |

(52) U.S. Cl.
CPC ..... *E04C 3/34* (2013.01); *E04C 5/0604* (2013.01); *E04C 5/0609* (2013.01); *E04F 17/08* (2013.01)

(58) Field of Classification Search
CPC ..... E04B 1/20; E04B 1/342; E04B 1/3505; E04B 1/3511; E04B 2/86; E04B 2/84; E04B 5/32; E04B 5/326; E04C 3/20; E04C 3/34; E04C 5/0604; E04C 5/0609; E04C 5/0618
See application file for complete search history.

(56) References Cited

FOREIGN PATENT DOCUMENTS

| | | | | | | |
|---|---|---|---|---|---|---|
| CN | 104652662 | A | * | 5/2015 | | |
| CN | 105649360 | A | * | 6/2016 | | |
| CN | 105804241 | A | * | 7/2016 | | |
| CN | 105804302 | A | * | 7/2016 | | |
| CN | 106013455 | A | * | 10/2016 | | |
| CN | 106013811 | A | * | 10/2016 | | |
| CN | 205875402 | U | * | 1/2017 | | |
| WO | WO-2009046572 | A1 | * | 4/2009 | ..... | E04B 1/161 |
| WO | WO-2011157228 | A1 | * | 12/2011 | ..... | E04G 17/14 |
| WO | WO-2012096639 | A1 | * | 7/2012 | ..... | E04B 1/161 |

* cited by examiner

BUILDING BASED ON LARGE-SPACE STRUCTURE AND FREESTANDING EXTERNAL ENVELOPE AS WELL AS CONSTRUCTION METHOD

TECHNICAL FIELD

The present invention belongs to the field of architectural engineering, and relates to a building based on a large-space structure and a freestanding external envelope as well as a construction method.

BACKGROUND

A reinforced concrete structure is widely used due to the advantages such as integrity, durability, good fireproof performance and seismic performance. The existing reinforced concrete structure mainly includes an integral reinforced concrete structure built by erecting a template on the construction site, reinforcing bars, and pouring concrete, and an integral reinforced concrete structure formed by placing reinforced concrete members prefabricated at factory or job site in position. Both of the two methods involve in the problem of reinforcing bars in the structure or the member, and the existing reinforcement technologies also include two major types.

One is that, after erecting the template on site, workers uses it as a working platform to conduct manual reinforcement, which has the defects of high safety risks, low manual operation efficiency, difficult control of precision and large deviation of reinforcement size while working at heights; the reinforced concrete structure formed usually has the quality defects such as exposed steel bars or uneven thickness of concrete covers, and there are even problems such as steel bar missing and wrong steel bars occurring during the artificial reinforcement process, thereby resulting in the reduction or loss of the bearing capacity of the reinforced concrete structure poured and formed finally.

The other one is that after the reinforced concrete girders, columns, slabs and other members prefabricated in the construction site or factory are transported to the site, the connecting node portions are reinforced artificially. In order to meet the connecting strength requirements of the prefabricated concrete members, the reinforcement of the connecting node is complicated, and the reinforcing bars are dense, the manual work space is very cramped, the construction is difficult, and the connecting quality and strength of the steel bars are difficult to guarantee, thereby affecting the overall strength and stability of the reinforced concrete structure.

The existing PC member (fully-prefabricated reinforced concrete member) has large self-weight, which is difficult to transfer, lift and position, and requires a large number of temporary auxiliary support facilities to be built on site; during the assembly process, vertical nodes need to be connected by slurry anchoring, which has high technical requirements, and complicated grouting construction technology and quality control measures; horizontal nodes need to be connected by ways of cast-in-place of template support, welding of pre-embedded steel plate, and connection of high-strength bolt, which has complicated process, high cost and poor reliability, does not conform to the current "Concrete Structure Design Specification" of China, and can only be used after passing the expert demonstration or authentication organized by relevant authorities.

The envelope structure refers to the wall, door, window, etc. surrounding the architectural space, and is a member (also including some accessories) that forms the architectural space and resists the adverse effects of the environment. The external envelope structure includes an external wall, a roof, a side window, an outer door, etc., which is used to withstand wind, rain, temperature change, solar radiation, etc., and shall have the performances such as thermal insulation, heat insulation, sound insulation, waterproof, dampproof, fireproof, and durability. The external envelope structure is made of brick, stone, earth, concrete, fiber cement plate, steel plate, aluminum alloy plate, glass, fiberglass and plastic. The external envelope structure can be divided into two types of single layer and multi-layer composite according to the structure: the single-layer structure includes brick wall, concrete wall, metal profiled wall, asbestos cement plate wall and glass plate wall of various thicknesses; the envelope structure of the multi-layer composite structure can be layered according to different requirements and in the combination of the material property, the outer layer is usually a protective layer, the middle layer is a thermal insulation or heat insulation layer (if necessary, a vapor prevention layer can also be provided), and the inner layer is an inner surface layer, and each layer either has a skeleton as a support structure or a reinforced inner protective layer as a support structure.

A flue is a smoke exhaust passage for a stove in a building. Generally, the flue naturally exhausts the smoke through the rising motion caused by the temperature difference of the air, and the cross-sectional area of the flue is determined according to the amount of smoke exhausted. The flue is mostly made of brick, or a pipe or clay pipe prefabricated by reinforced concrete, and the cross section can be a square, a rectangle, a circle or an ellipse. The inner surface of the flue wall needs to be smooth, flat, closed and airtight with no smoke and less ash. The low-rise building often has separate flue pipe according to the stove, the multi-story or high-rise building usually uses child-mother flue, and the appropriate portion of the child-mother flue shall be provided with an ash-removing port to facilitate ash cleaning.

At present, rainwater down pipe, equipment pipe, water supply and drainage pipes, power cable pipe, gas pipe and signal cable pipe are scattered in the building, or are embedded or laid in passing pipes of the building structure body and envelope body during the construction phase of the building, or the holes are drilled in the subsequent decoration and installation to arrange the passing pipe.

SUMMARY

Technical problems: the present disclosure provides a building based on a large-space structure body and a freestanding external envelope structure and a construction method which can implement the assembly of ultra-large members and reinforced concrete civil buildings with large structure space that cannot be completed by the existing member and process, simplify the process, decrease high-altitude operations, reduce the transferring cost, improve the efficiency, is convenient for field positioning, and has controllable process; meanwhile, the invention improves the comprehensive functionality, the assembly fault tolerance and the maintaining convenience of the whole external envelope system, improves the installing precision and efficiency, simplifies the process, and greatly increases the working efficiency, the utilization ratio and safety of lifting devices.

Technical solutions: the building based on a large-space structure body and a freestanding external envelope structure according to the present invention comprises a structure body composed of a vertical-structure reinforced concrete member, a reinforced concrete girder and a reinforced concrete slab, and a freestanding combined external envelope system externally hung in a periphery of the structure body; and the structure body is made of a prefabricated combined reinforcement cage member poured with concrete, the prefabricated combined reinforcement cage member is combined and assembled by a prefabricated vertical-structure reinforcement cage member, a prefabricated girder reinforcement cage member and a prefabricated slab reinforcement cage member, and the prefabricated vertical-structure reinforcement cage member is a prefabricated shear wall reinforcement cage member or a prefabricated column reinforcement cage member; the prefabricated shear wall reinforcement cage member comprises a plurality of prefabricated edge constraint members, a reinforcement mesh connected with the prefabricated edge constraint members, and a dismantle free mould arranged outside the reinforcement mesh, the reinforcement mesh is arranged along a wall surface of the shear wall to encircle and connect all the prefabricated edge constraint members together, and the dismantle free mould is integrally connected to the reinforcement mesh through a positioning and fixing member. The prefabricated column reinforcement cage member comprises a reinforcement member and a dismantle free mould, the dismantle free mould is arranged along a column surface of the column to encircle the reinforcement member and integrally connected therewith. The prefabricated girder reinforcement cage member comprises the reinforcement member and the dismantle free mould connected with the reinforcement member, the reinforcement member is formed by connecting a horizontal reinforcing bar with a stirrup, the dismantle free mould is arranged along front and back side surfaces and a bottom surface of the prefabricated girder and integrally connected therewith through a positioning and fixing member. The prefabricated slab reinforcement cage member comprises a bottom mould, and a reinforcement truss installed above the bottom mould, the bottom mould comprises a plurality of longitudinal bearing templates arranged in parallel, and a plurality of horizontal bearing templates arranged between two adjacent longitudinal bearing templates, the longitudinal bearing templates are integrally connected with the horizontal bearing templates at two sides, the reinforcement truss is arranged above the horizontal bearing template, all the reinforcement trusses are integrally connected through a reinforcement bar arranged above the longitudinal bearing template, and the reinforcement bar and the reinforcement truss are connected and installed with the longitudinal bearing template at the same time.

The freestanding combined external envelope system comprises a concrete external wall plate, a flue external wall plate, a pipeline corridor external wall plate and a curtain wall plate arranged along a periphery of the building, the flue external wall plate is correspondingly installed and communicated with an exhaust pipeline of each household in the building, the pipeline corridor external wall plate is correspondingly installed and communicated with a rainwater down pipe, an equipment pipe, water supply and drainage pipelines, a power cable pipe, a gas pipe or a signal cable pipe of each household in the building. The concrete external wall plate, the flue external wall plate, the pipeline corridor external wall plate and the curtain wall plate are all externally hung on the structure body of the building by means of installing and positioning by a connector bolt, a plurality of concrete external wall plates on the building are arranged by interval, and the flue external wall plate, the pipeline corridor external wall plate or the curtain wall plate is installed between two adjacent concrete external wall plates.

Further, in the building of the present invention, the prefabricated shear wall reinforcement cage member is a line-shaped, T-shaped, L-shaped, H-shaped or Z-shaped structure, the members of the T-shaped structure and the H-shaped structure comprise two types of the prefabricated edge constraint members, one type of the prefabricated edge constraint member is located at an outer edge of a web member and a flange member, and is a reinforcement member formed by connecting a vertical reinforcing bar with a spiral stirrup, the other type of the prefabricated edge constraint member is located at an intersection area of the web member and the flange member, and consists of four reinforcement members above, wherein one reinforcement member is located at an intersection and connection area of the web member and the flange member, the remaining three reinforcement members are arranged closely adjacent to three side surfaces of the reinforcement member, and the four reinforcement members are integrally connected in a web direction and a flange direction through a horizontal stirrup respectively. The members of the L-shaped structure and the Z-shaped structure comprise two types of the prefabricated edge constraint members, one type of the prefabricated edge constraint member is located at an outer edge of the member, and is a reinforcement member formed by connecting a vertical reinforcing bar with a spiral stirrup, the other type of the prefabricated edge constraint member is located at an L-shaped intersection area, and is formed by the three reinforcement members above connected in pairs through the horizontal stirrup, wherein one reinforcement member is located at an L-shaped intersection and connection area of the members, and the remaining two reinforcement members are arranged closely adjacent to two side surfaces of the reinforcement member.

Further, in the building of the present invention, one of following two structures is used in the prefabricated column reinforcement cage member:

a) only one reinforcement member is arranged, the reinforcement member is a reinforcement member formed by connecting a vertical reinforcing bar with a stirrup, and the dismantle free mould is directly arranged along an outer side of the reinforcement member and is connected with the stirrup through a positioning and fixing member, so that the dismantle free mould is integrally connected with the reinforcement member; and b) a plurality of reinforcement members are arranged, an external stirrup constraining and integrally connecting the plurality of reinforcement members is arranged meanwhile, the reinforcement member is a reinforcement member formed by connecting a vertical reinforcing bar with a stirrup, or a reinforcement member formed by connecting a vertical reinforcing bar with a clamping member, and the dismantle free mould is arranged along an outer side of the external stirrup, and is connected therewith through a positioning and fixing member, so that the dismantle free mould is integrally connected with the reinforcement member.

Further, in the building of the present invention, one of following two structures is used in the prefabricated girder reinforcement cage member:

a) only one reinforcement member is arranged, and the dismantle free mould is directly arranged along the front and back side surfaces and the bottom surface of the reinforcement member and is integrally connected with the stirrup; and b) a plurality of reinforcement members are arranged, an external stirrup constraining and integrally connecting the plurality of reinforcement members is arranged meanwhile, and the dismantle free mould is connected with the external stirrup, so that the dismantle free mould is integrally connected with the reinforcement member.

Further, in the building of the present invention, n the prefabricated slab reinforcement cage member, a positioning member is arranged at an intersection of the longitudinal bearing template and the horizontal bearing template, the reinforcement truss is fixedly connected onto the longitudinal bearing template through the positioning member, and the longitudinal bearing template is an inverted U-shaped plate member.

Further, in the building of the present invention, a sleeve is arranged at both an edge of the reinforcement member of the prefabricated girder reinforcement cage member and an edge of the reinforcement truss of the prefabricated slab reinforcement cage member, a detachable preassembled movable reinforcement bar is temporarily fixed in the reinforcement member and the reinforcement truss, the preassembled movable reinforcement bar can be inserted into the sleeve along a horizontal direction after being detached and connected and assembled with other reinforcement cage members.

Further, in the building of the present invention, the flue external wall plate is a box-shaped member internally provided with a through flue, comprising a built-in flue, an outer frame and a panel arranged on the outer frame, the outer frame is formed by connecting supporting rods arranged on a seamed edge of the box-shaped member, and a heat-preservation layer is filled between the built-in flue and the panel. The pipeline corridor external wall plate comprises a supporting member and a fastening panel, the supporting member can be spliced and fastened with the fastening panel to form a box-shaped pipeline corridor member encircling external portions of the rainwater down pipe, the equipment pipe, the water supply and drainage pipes, the power cable pipe, the gas pipe or the signal cable pipe, and the heat-preservation layer is arranged inside the fastening panel.

A construction method of a building based on a large-space structure body and a freestanding external envelope structure according to the present invention comprises the following steps of:

1) manufacturing a prefabricated edge constraint member, a reinforcement mesh, a dismantle free mould, a reinforcement member, a longitudinal bearing template, a horizontal bearing template, a concrete external wall plate, a flue external wall plate, a pipeline corridor external wall plate and a curtain wall plate at a factory;

2) respectively assembling a prefabricated vertical-structure reinforcement cage member, a prefabricated girder reinforcement cage member and a prefabricated slab reinforcement cage member, and lifting the prefabricated vertical-structure reinforcement cage member to a construction station to install and position;

3) positioning and installing a girder member supporting apparatus, then lifting the girder reinforcement cage member and arranging the girder reinforcement cage member on the supporting apparatus, and connecting the girder reinforcement cage member with the prefabricated vertical-structure reinforcement cage member at a connected portion;

4) positioning and installing a slab member supporting apparatus, then lifting the slab reinforcement cage member and arranging the slab reinforcement cage member on the supporting apparatus, and respectively connecting the slab reinforcement cage member with the girder reinforcement cage member and the prefabricated vertical-structure reinforcement cage member at a connected portion;

5) placing a molding filling block on a mesh unit encircled by the longitudinal bearing template and the horizontal bearing template in a bottom mould to install and position;

6) laying the reinforcement mesh on a reinforcement truss to install and position;

7) pouring concrete in cavities of the prefabricated vertical-structure reinforcement cage member, the prefabricated girder reinforcement cage member and the prefabricated slab reinforcement cage member to maintain and mold;

8) dismounting girder member supporting apparatus, the slab member supporting apparatus, and the bottom mould to finally obtain a reinforced concrete structure body;

9) lifting an external envelope member to a periphery of the building, wherein two adjacent external envelope members are arranged by interval and are externally hung and connected with the structure body of the building respectively through a part of connecting points for coarse positioning, and the remaining connecting points reserved are used for subsequent fine positioning of the external envelope members, and the external envelope member is the concrete external wall plate, the flue external wall plate, the pipeline corridor external wall plate or the curtain wall plate; and 10) finely positioning the external envelope member which is coarsely positioned, then lifting the external envelope member into the interval between two adjacent external envelope members to connect and position with the structure body of the building, so as to complete the connection and installation of the external envelope member and the structure body.

Further, in the method according to the present invention, the prefabricated vertical-structure reinforcement cage member is a prefabricated shear wall reinforcement cage member or a prefabricated column reinforcement cage member, and an assembly method of the prefabricated shear wall reinforcement cage member comprises:

distributing and positioning a plurality of prefabricated edge constraint members according to the design of a shear wall and reinforcing requirements, then arranging the reinforcement mesh along a wall surface of the shear wall, and connecting the reinforcement mesh with each of the prefabricated edge constraint members, so as to connect all the prefabricated edge constraint members together; and arranging a dismantle free mould along an outer side of the reinforcement mesh, and integrally connecting the dismantle free models opposite at two sides of the member using a positioning and fixing member;

an assembly method of the prefabricated column reinforcement cage member comprises:

distributing and positioning a reinforcement member, then arranging the dismantle free mould along a column surface of the column, and integrally connecting the dismantle free mould with the reinforcement member: for the prefabricated column reinforcement cage member provided with one reinforcement member only, directly arranging the dismantle free mould along an outer side of the reinforcement member and connecting the dismantle free mould with a stirrup; for the prefabricated column reinforcement cage member provided with a plurality of reinforcement members, distributing and positioning the plurality of reinforcement members according to the design of the column and a reinforcing requirement, then arranging an external stirrup to constrain and integrally connect all the reinforcement members, finally arranging the dismantle free mould along an outer side of the external stirrup, and connecting the dismantle free mould with the external stirrup; and integrally connecting the dismantle free moulds opposite at two sides of the member using a positioning and fixing member;

an assembly method of the prefabricated girder reinforcement cage member comprises:

distributing and positioning a reinforcement member, then arranging the dismantle free mould along front and back side surfaces and a bottom surface of the girder, and integrally connecting the dismantle free mould with the reinforcement member: for the prefabricated girder reinforcement cage member provided with one reinforcement member only, directly arranging the dismantle free mould along front and back side surfaces and a bottom surface of the reinforcement member and connecting the dismantle free mould with a stirrup; for the prefabricated girder reinforcement cage member provided with a plurality of reinforcement members, distributing and positioning the plurality of reinforcement members according to the design of the girder and a reinforcing requirement, then arranging an external stirrup to constrain and integrally connect all the reinforcement members, finally arranging the dismantle free mould along the front and back side surfaces and the bottom surface of the girder, and connecting the dismantle free mould with the external stirrup; and integrally connecting the dismantle free moulds at two side surfaces and the bottom surface of the member using a positioning and fixing member.

Further, in the construction method of the prefabricated combined reinforcement cage member according to the present invention, an assembly method of the prefabricated slab reinforcement cage member comprises:

arranging a plurality of longitudinal bearing templates in parallel, arranging a plurality of horizontal bearing templates between two adjacent longitudinal bearing templates, and integrally connecting the longitudinal bearing templates with the horizontal bearing templates; and arranging and installing the reinforcement truss above the horizontal bearing template, arranging and installing the reinforcement bar above the longitudinal bearing template, and integrally connecting the reinforcement truss with the reinforcement bar through a positioning member in a crossed manner to form the reinforcement truss, wherein the positioning member integrally connects the reinforcement truss and the reinforcement bar with the longitudinal bearing templates below at the same time.

Further, in the method according to the present invention, the external envelope member and the structure body are installed and positioned through a connector bolt, in step 9), the concrete external wall plates are arranged by interval, then in step, the other types of the external envelope members are lifted and installed, the coarse positioning is to control a positioning accuracy within ±5 cm, and the fine positioning is to control the positioning accuracy within ±3 mm.

Beneficial effects: compared with the prior art, the present invention has the following advantages.

The present invention is formed by combining a reinforced concrete structure body molded on site and a free-standing combined external envelope system, and conforms to the national reinforced concrete structure design specification in terms of stress principle and structure principle.

The existing method is manual combined assembly of single reinforcement bar on a site station, a member method is used in the present invention for reinforcing, and the reinforcement bar is processed into the reinforcement cage member conforming to the national reinforced concrete reinforcement specification, so as to realize industrial flow production on the premise of conforming to the current national cast-in-place reinforced concrete design specification.

According to the present invention, basic reinforcement accessories manufactured by industrial production at a factory are used as the reinforcement member, various rigid reinforcement cage members are assembled based on these reinforcement members, and after these members are further connected and assembled together, a complete reinforcement cage structure is formed. The technical routes of manufacturing of basic accessories, hierarchical assembly of members and on-site assembly of large members are used in the present invention to combine the industrial flow production with on-site assembly, so as to realize the large rigid reinforcement cage member, meet the construction requirements on the large-space reinforcement cage of the structure, is no longer limited by factors such as size, weight and the like of factory manufacturing and transportation links, can realize the super-large member assembly that cannot be completed by the existing member and process, and can realize the reinforced concrete civil building with large structure space. The present invention realizes the novel industrial construction of division of responsibilities and cooperation through member and rigid component based reinforcing, the factory production of members, and the multi-level assembly of large members.

The present invention hierarchically assembles the industrial small members (reinforcement members, etc.) to eventually form the large reinforcement cage member with rigidity. After the large reinforcement cage member is combined with the template system, the subsequent structure construction of the building is conducted, which simplifies the installation process, reduces operations at heights, can meet the current national cast-in-place reinforced concrete reinforcement specification, and realizes the installation combination of the reinforcement bars by steps. In addition, the present invention reduces the cost, improves the efficiency and avoids the damage in transportation due to the ability and convenience of transportation of the reinforcement member.

In the process method of the present invention, the entire combination of the rigid reinforcement cage member is realized by lifting it to the station for fixture positioning after on-site assembly (arranged on a positioning support system), thereby forming a large rigid reinforcement cage structure body, and the connection of the reinforcement bar by steps is conducted again to form the entire large structure space of the rigid reinforcement cage on the premise of meeting the national specification, so as to realize the reinforcement assembly engineering of large-space concrete structure. The present invention is convenient in construction and deployment, greatly improves the assembly quality, efficiency and positioning support accuracy, simplifies the work procedure and reduces the assembly process difficulty. The concept of a preassembly system is used in the present invention, which has a light self-weight, and can form a larger-scale member; the system itself has sufficient rigidity, which is suitable for entire transportation and lifting; the system is stable and can bear loads by itself as long as simple auxiliary supports are set, which is convenient to position on site, and is controllable in process.

The prefabricated shear wall, girder and slab reinforcement cage members provided by the present invention conform to the current Concrete Structure Design Specification of the state, and industrial flow line production can be conducted on them, the members have light dead-weight, and can be combined to form a larger-scale member; the members themselves have sufficient rigidity, which are suitable for entire transportation and lifting; the members are stable and can bear loads by themselves as long as simple auxiliary supports are set, which is convenient to position on site. After the prefabricated shear wall, girder and slab reinforcement cage members are lift on site, a few positioning and assembly operations of manual reinforcing at connecting nodes are conducted, so that the working procedure is simpler and more efficient.

The prefabricated shear wall reinforcement cage member of the present invention is composed of the prefabricated edge constraint member, the reinforcement mesh and the dismantle free mould, the prefabricated column reinforcement cage member is composed of the reinforcement member and the dismantle free mould, which has a light self-weight, and can form a larger-scale member; the prefabricated shear wall reinforcement cage member itself has sufficient rigidity, which is suitable for entire transportation and lifting; the member is stable and can bear loads by itself as long as simple auxiliary supports are set, which is convenient to position on site.

In the prefabricated shear wall reinforcement cage member of the present invention, the prefabricated edge constraint member is set in a freestanding manner, all the prefabricated edge constraint members are connected together by the reinforcement meshes which are integrally installed at once, thereby avoiding binding the prefabricated edge constraint members one by one, which greatly improves the installation efficiency, simplifies the working procedure and reduces the labor intensity.

The setting of the dismantle free mould allows a part of free water in the concrete to be filtered out, reduces the water-cement ratio on the surface and improves the surface strength of the concrete member; changes the container effect of the mold, and reduces the side pressure on the template; and the dismantle free steel mesh template enhances the crack resistance of the concrete member.

The prefabricated reinforcement cage member provided by the present invention is provided with the dismantle free mould, the dismantle free mould is provided with an opening hole, so that the free water of the concrete poured can be partially filtered out, and the water-cement ratio of the concrete protective layer is reduced, thereby increasing the strength of the concrete protective layer; the opening hole arranged on the dismantle free mould weakens the container effect of the traditional template and reduces the side pressure of the cast-in-place concrete on the template; the dismantle free mould also plays a role of constraint strengthening similar to the grid cloth, improves the crack resistance of the concrete protective layer on the surface of the shear wall, and further improves the durability of the reinforced concrete shear wall member.

The prefabricated reinforcement cage member of the present invention is composed of the reinforcement member and the dismantle free mould, the member has a light self-weight, and can form a larger scale member; the member itself has sufficient rigidity, which is suitable for entire transportation and lifting; the member is stable and can bear loads by itself as long as simple auxiliary supports are set, which is convenient to position on site.

The prefabricated slab reinforcement cage member provided by the present invention is provided with the longitudinal and horizontal bearing templates and the filling blocks, which do not need to erect templates after the member is lift in place at once, the reinforcement truss, the longitudinal and horizontal bearing templates in the prefabricated slab reinforcement cage member have sufficient rigidity and strength, which only requires to erect simple support facility on site, so that the working procedure is greatly simplified and the construction efficiency is higher. The longitudinal and horizontal bearing templates are connected with the bottom of the reinforcement truss through bolts, and can be removed conveniently and quickly after pouring and molding of the concrete.

According to the present invention, basic accessories are manufactured by industrial production at the factory to manufacture the longitudinal and horizontal bearing templates, and then the bottom template is formed by cross arrangement on the basis of these basic units, and is connected with the reinforcement truss above to form the completed slab reinforcement cage member. The technical routes of manufacturing of basic accessories at the factory, hierarchical assembly of members and on-site assembly of large members are used in the present invention to combine the industrial flow production with on-site assembly, so as to realize the large member, meet the large-space construction requirements, is no longer limited by factors such as size, weight and the like of factory manufacturing and transportation links, can realize the super-large member assembly that cannot be completed by the existing member and process, and can realize the reinforced concrete civil building with large structure space. The present invention realizes the novel industrial construction of division of responsibilities and cooperation through member and rigid component based reinforcing, the factory production of members, and the multi-level assembly of large members.

The reinforcing bar of the reinforced concrete structure body molded on site and provided by the present invention conforms to the current Concrete Structure Design Specification of the state, the internal reinforcing bar is combined by the prefabricated reinforcement cage member, the prefabricated reinforcement cage member is produced through the industrial flow line, which has a light self-weight, and is convenient to combine and form the larger-scale member; the prefabricated reinforcement cage member itself has sufficient rigidity, which is suitable for entire transportation and lifting; the member is stable and can bear loads by itself as long as simple auxiliary supports are set, which is convenient to position on site. After the prefabricated shear wall, girder and slab reinforcement cage members are lift on site, a few positioning and assembly operations of manual reinforcing at connecting nodes are conducted, so that the working procedure is simpler and more efficient.

In the freestanding combined external envelope system of the present invention, the external envelope member is connected with the structure body in a freestanding manner, and the external envelope member is installed in a freestanding manner, which realizes continuous splicing through matching and combining different members, and jointing of the connecting seams and the heat-preservation layer, thus forming a completed external envelope system, and improving the functionality, fault tolerance of assembly and convenience of the entire external envelope system.

The assembly process combining coarse positioning and fine positioning is used in the present invention, the concrete external wall plates (heavy plate) with great positioning difficulty are firstly lift and installed, and then the light plates (the flue external wall plate, the pipeline corridor external wall plate and the curtain wall plate) are lift and installed, so that the gaps can be accurately controlled, the installation accuracy and efficiency are improved, the construction organization and deployment are facilitated, the installation difficulty is reduced, the simplification and intensification of process procedure is realized, and the waste is avoided.

According to the present invention, the concrete external wall plates (heavy plate) are lift by interval, the nodes are connected by bolts and coarsely positioned, so that the gaps between the plates can be accurately controlled, which provides convenient condition for fine positioning of the heavy plates. After the fine positioning of two adjacent lift concrete external wall plates (heavy plates), the light plates are lift and installed, thereby improving the installation and positioning accuracy of each freestanding member and the entire external envelope system, simplifying the process, and greatly improving the working efficiency and the utilization rate of the lifting equipment.

In the external envelope structure system of the present invention, the flue after household separation is connected to an externally-hung flue external wall plate that is uniformly arranged and specially customized, the flue is creatively combined with the external envelope member and the building structure, the opening on the building slab structure and the damage to the member are reduced, and the type and appearance of the structural member are simplified, which is conductive to the standardization of the structural member; and the flue external wall plate is a standard member manufactured in factory, thereby greatly simplifying the process of construction site and improving the working efficiency.

In the external envelope structure system of the present invention, the water supply and drainage pipelines after household separation, the power cable pipe, and the signal cable pipe are connected to the externally-hung pipeline corridor external wall plate that is uniformly arranged and specially customized, a pipeline channel is creatively combined with the external envelope member and the building structure body, the opening in the building structure body and the type of the member are reduced, and the appearance of the structure body is simplified, which is conductive to the standardization thereof; and the pipeline corridor external wall plate is a standard member manufactured in factory, thereby greatly simplifying the process of construction site and improving the working efficiency. The centralized installation and layout of pipelines ensures the functional use of equipment, improves the safety, and is also beautiful and practical; the pipeline corridor external wall plate is provided with an opening for observation, maintenance and installation, which is convenient for the maintenance of pipeline and equipment in the future.

The concrete external wall plate, the flue plate and the like of the present invention are produced at the factory, so that the manufacturing efficiency is high and the quality is easy to control. The external envelop structure system member can be combined to form the larger-size member, which is suitable for mechanical lifting and easy to position. Wet operations, template operations and high-altitude outdoor operations on site are not necessary, and the construction is transferred from the open air to the inside of the factory or building, thus reducing the labor intensity of workers on one hand, and ensuring the safety of workers, and improving the working efficiency on the other hand, so as to shorten the construction period. The scaffold and other auxiliary operation facilities do not need to be built on site, which can simplify the construction steps and save the cost.

Figure 1:
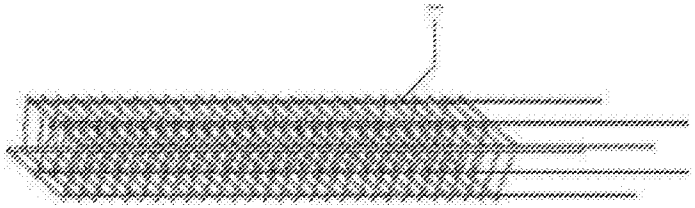
FIG. 1 is a schematic diagram of a prefabricated edge constraint member at an edge of a prefabricated shear wall reinforcement cage member structure.
Figure 2:
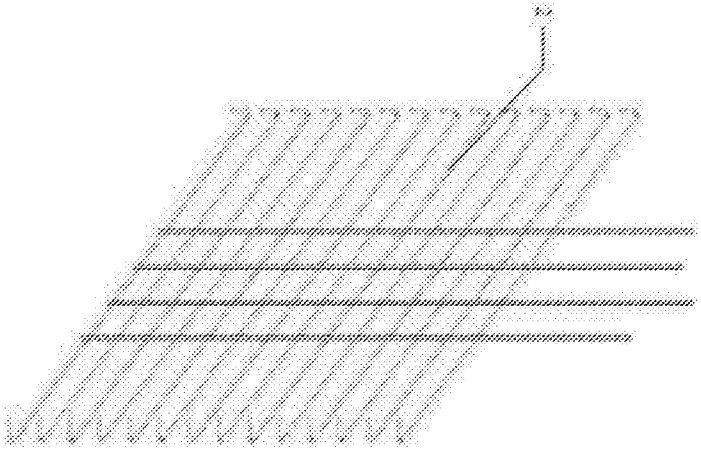
FIG. 2 is a schematic diagram of a reinforcement mesh.
Figure 3A:
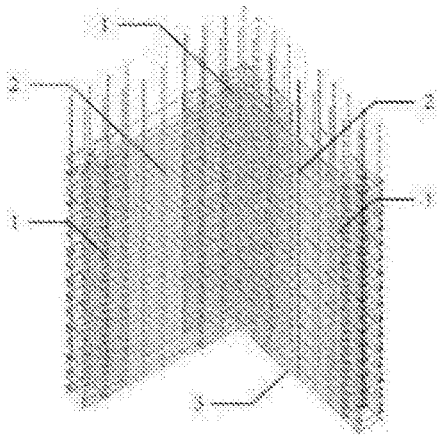
FIG. 3*a* is a schematic diagram of an L-shaped shear wall.
Figure 3B:
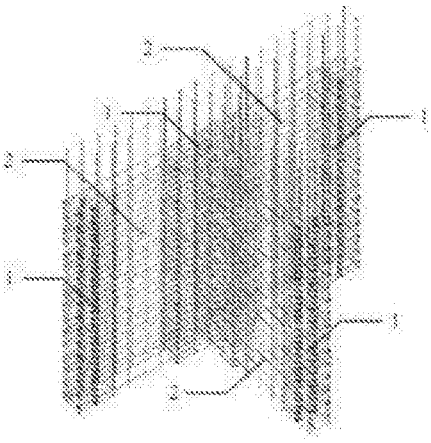
FIG. 3*b* is a schematic diagram of a T-shaped shear wall.
Figure 3C:
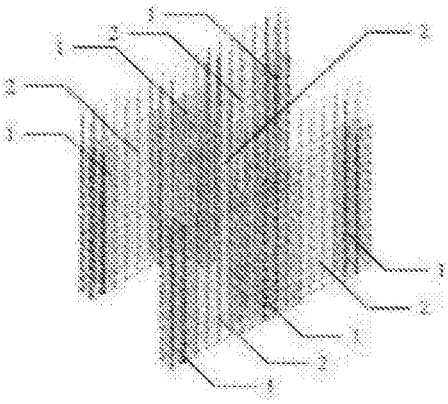
FIG. 3*c* is a schematic diagram of an H-shaped shear wall.
Figure 3D:
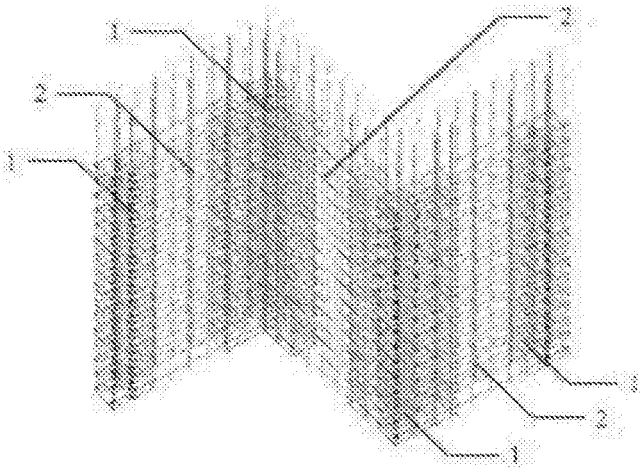
FIG. 3*d* is a schematic diagram of a Z-shaped shear wall.
Figure 4:
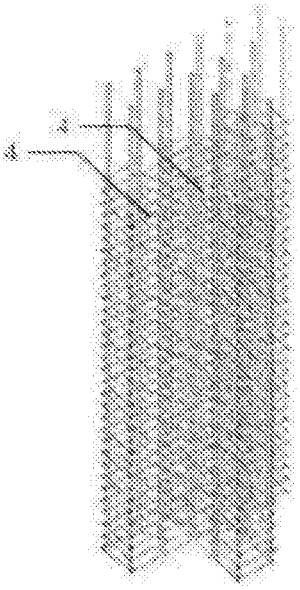
FIG. 4 is a schematic diagram of a prefabricated edge constraint member at an intersection area of T-shaped and L-shaped prefabricated shear wall reinforcement cage member structures.
Figure 5:
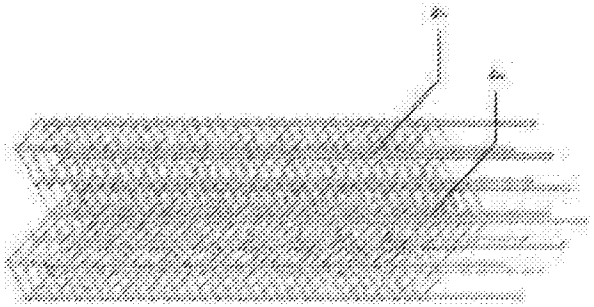
FIG. 5 is a schematic diagram of a prefabricated edge constraint member at an intersection area of L-shaped and Z-shaped prefabricated shear wall reinforcement cage member structures.
Figure 6:
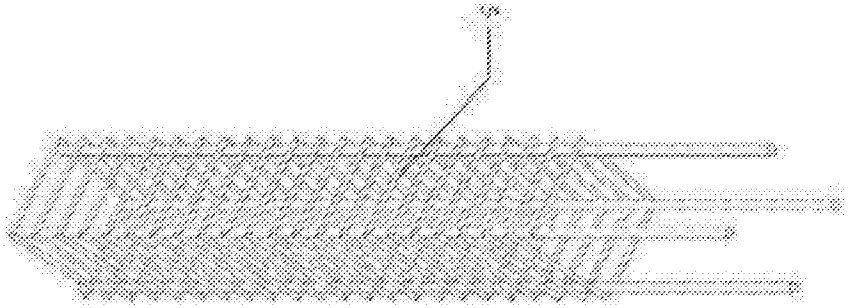
FIG. 6 is a schematic diagram of a prefabricated column reinforcement cage member provided with one reinforcement member.
Figure 7:
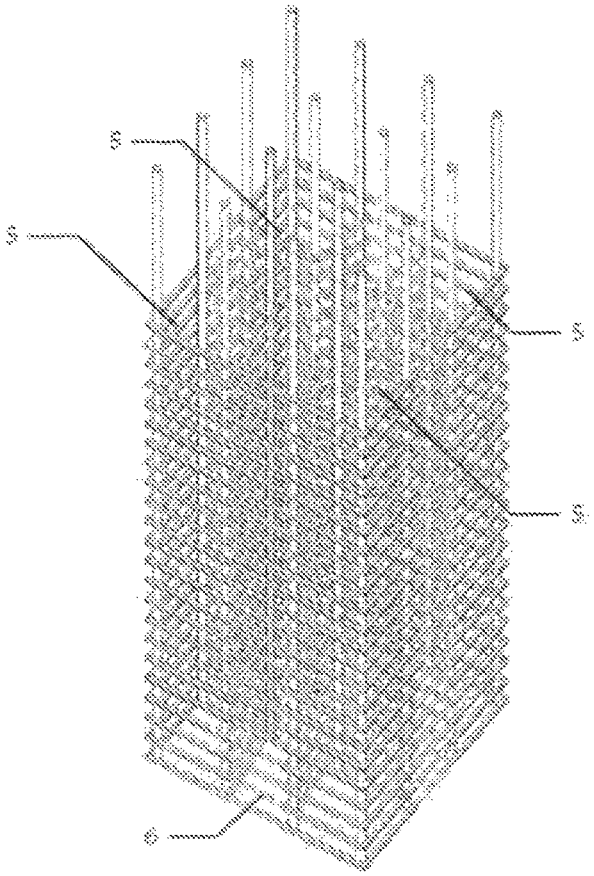
FIG. 7 is a schematic diagram of a prefabricated column reinforcement cage member provided with a plurality of reinforcement members.
Figure 8:
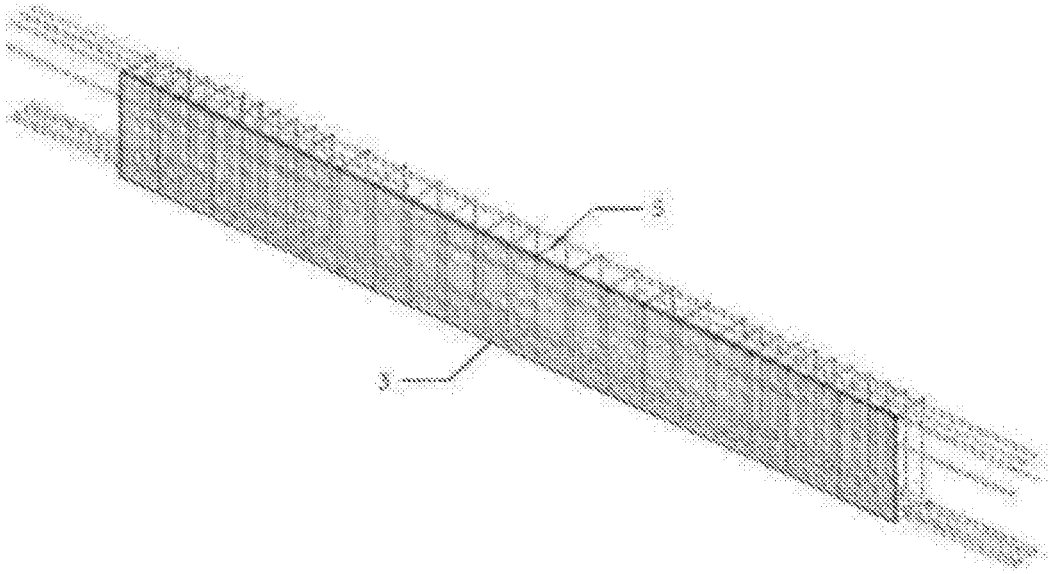
FIG. 8 is a schematic diagram of a reinforcement member in a prefabricated girder.
Figure 9:
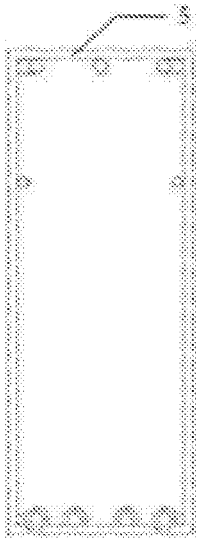
FIG. 9 is a schematic diagram of a section of a reinforcement cage member in a prefabricated girder according to the present invention.
Figure 10:
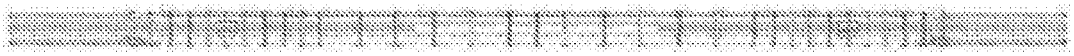
FIG. 10 is a top view of FIG. 9.
Figure 11:
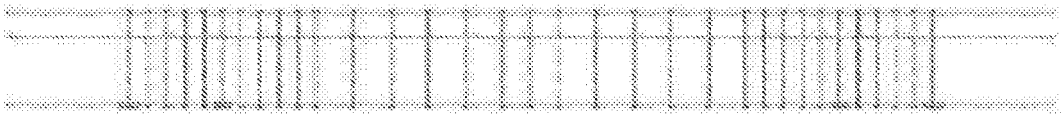
FIG. 11 is an elevation drawing of FIG. 9.
Figure 12:
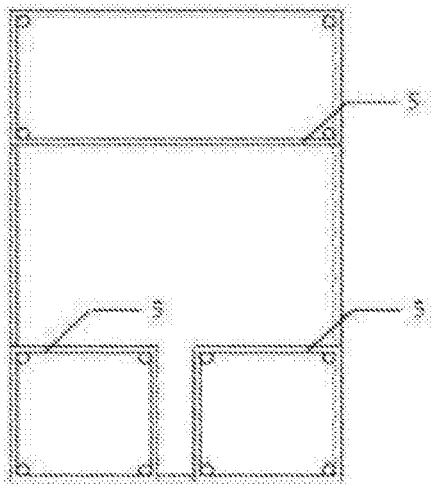
FIG. 12 is a schematic diagram of a prefabricated girder reinforcement cage member provided with a plurality of reinforcement members.
Figure 13:
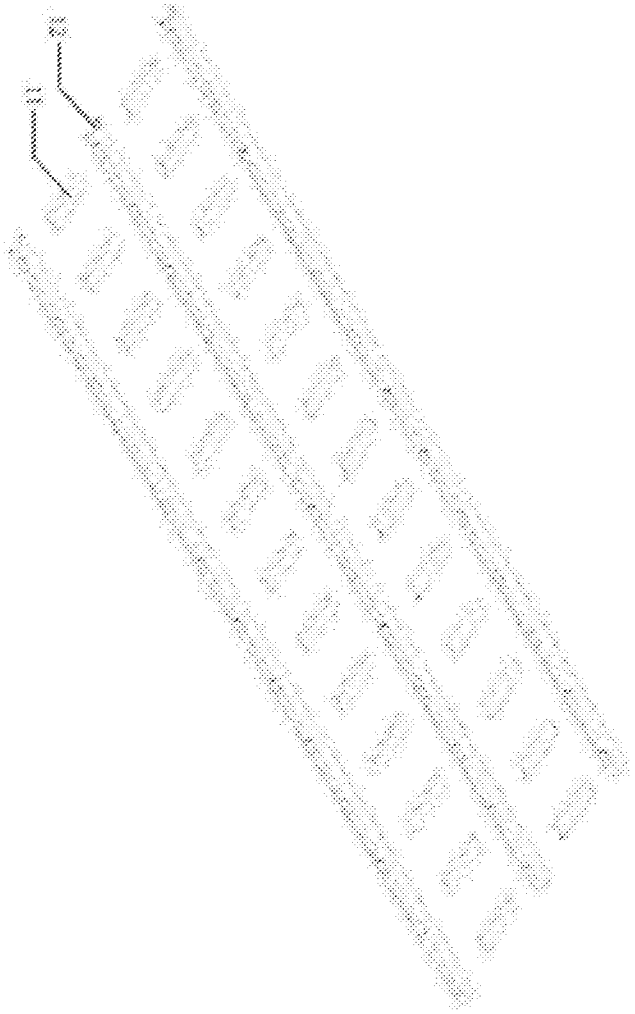
FIG. 13 is an exploded schematic diagram of a bottom mould.
Figure 14:
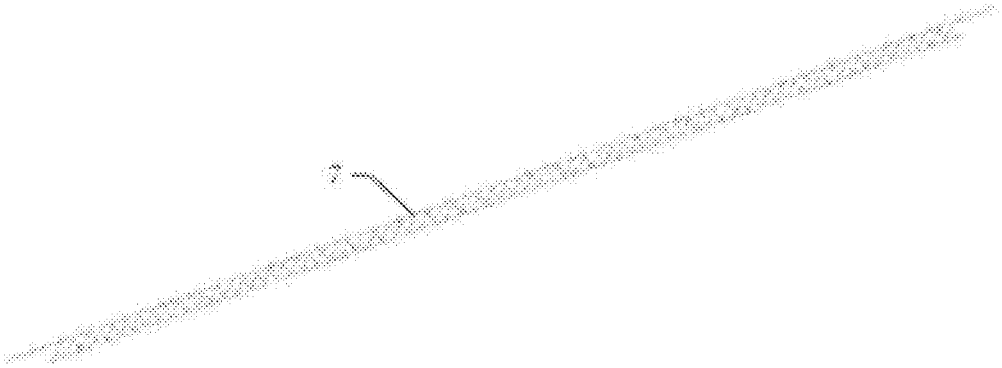
FIG. 14 is a schematic diagram of a reinforcement truss.
Figure 15:
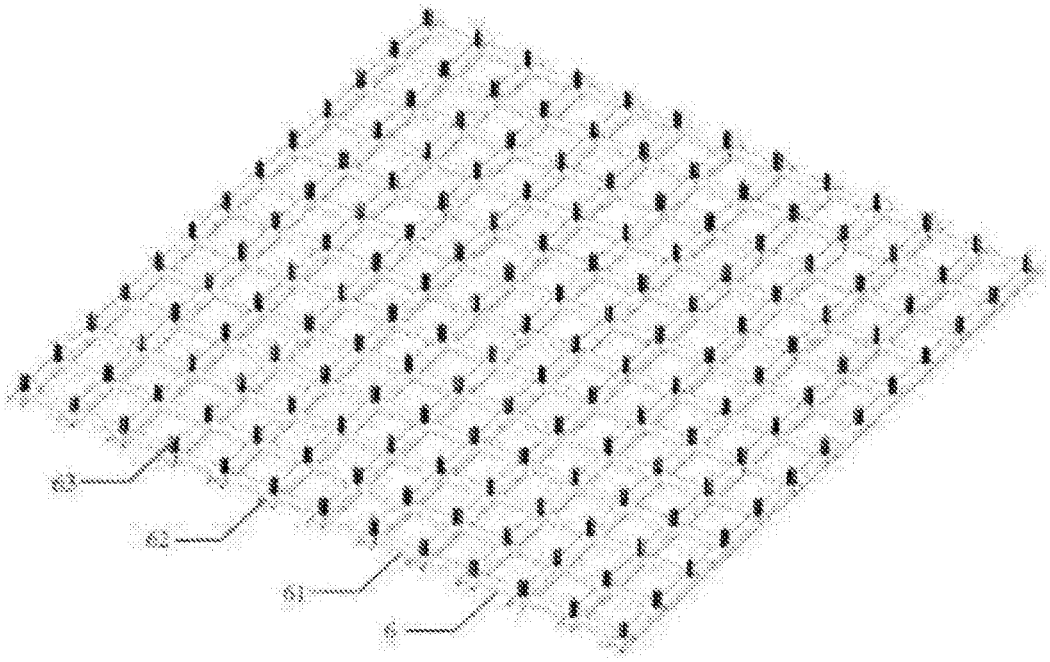
FIG. 15 is a schematic diagram of the bottom mould after being installed with a connector.
Figure 16:
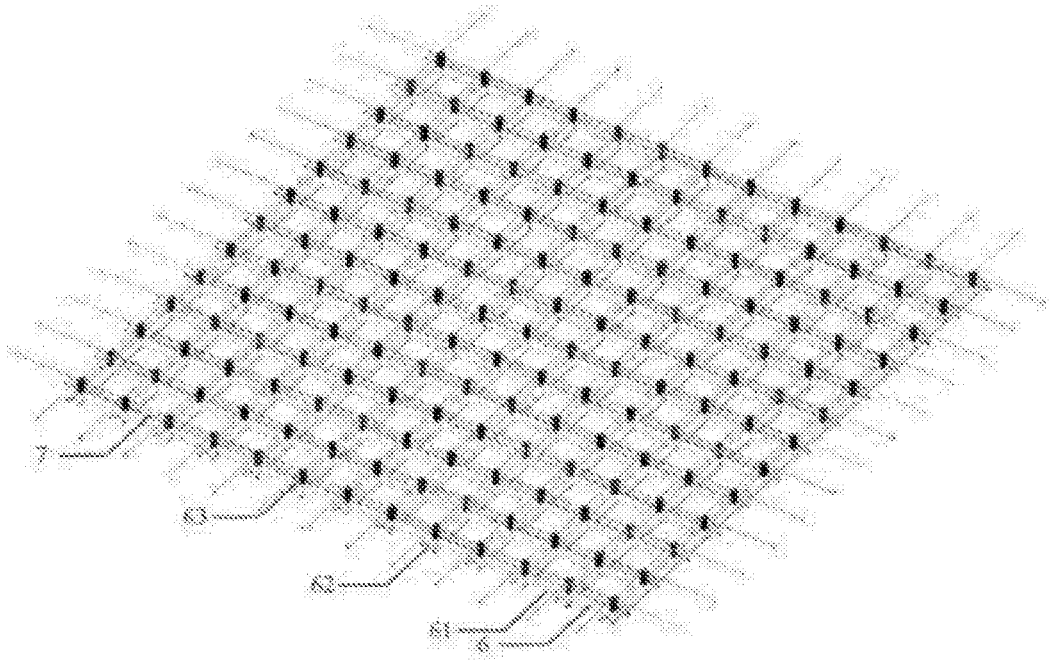
FIG. 16 is a schematic diagram of the bottom mould installed and connected with a reinforcement truss.
Figure 17:
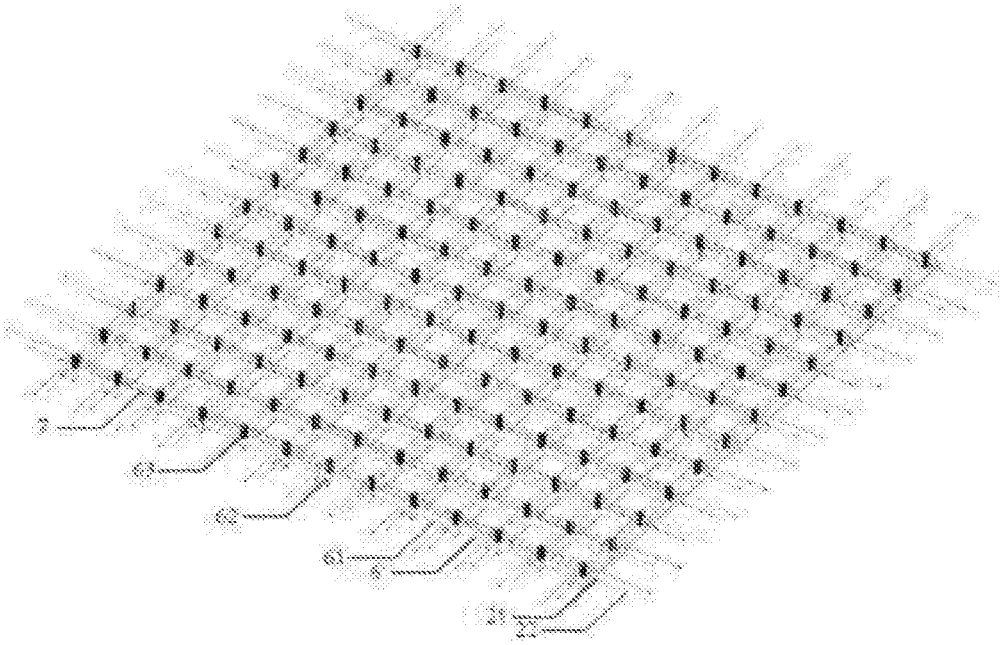
FIG. 17 is a schematic diagram of installing and connecting a reinforcement truss with a preassembled movable reinforcement bar.
Figure 18:
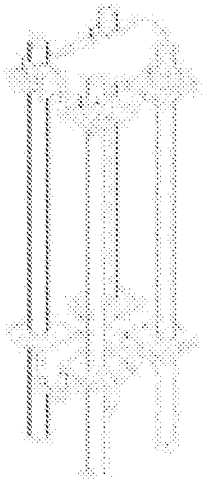
FIG. 18 is a schematic diagram of a positioning member.
Figure 19:
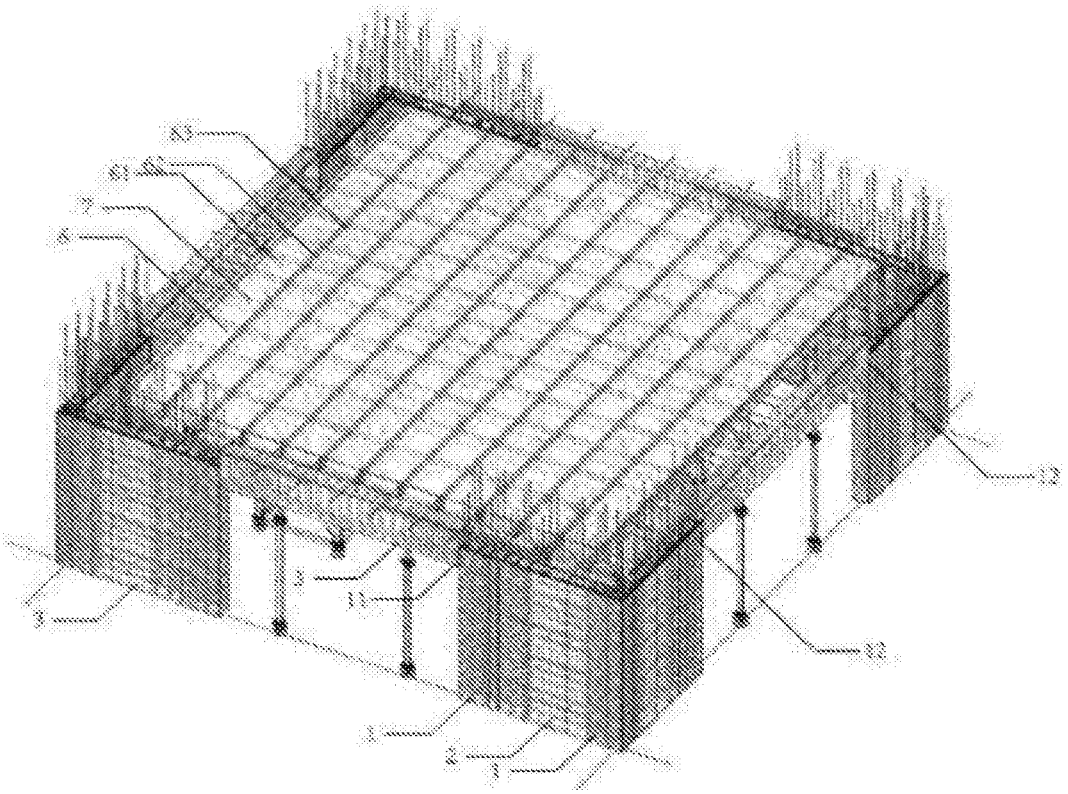
FIG. 19 is a schematic diagram of a prefabricated combined reinforcement cage member.
Figure 20A:
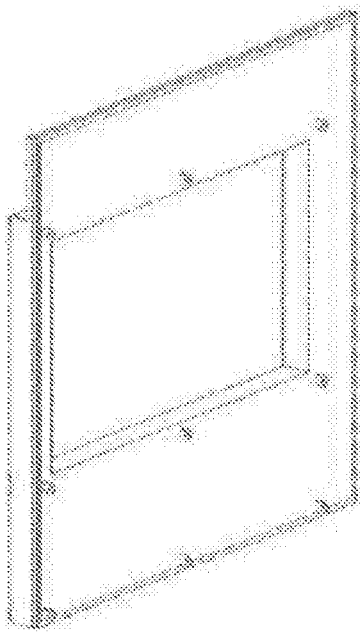
FIG. 20*a* is a schematic diagram of a front surface of a concrete external wall plate.
Figure 20B:
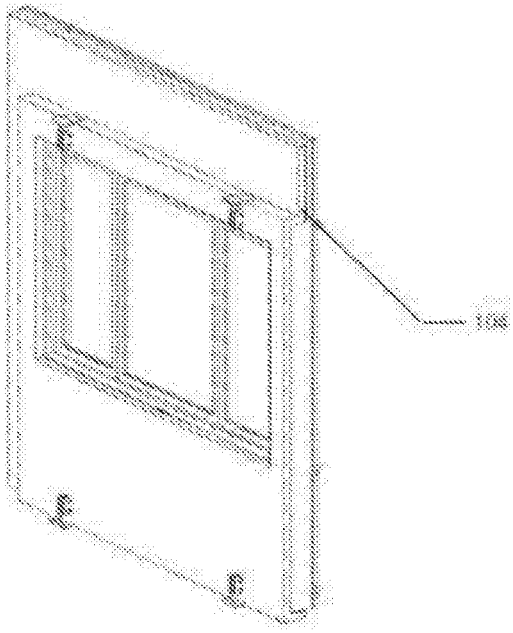
FIG. 20*b* is a schematic diagram of a back surface of the concrete external wall plate.
Figure 21A:
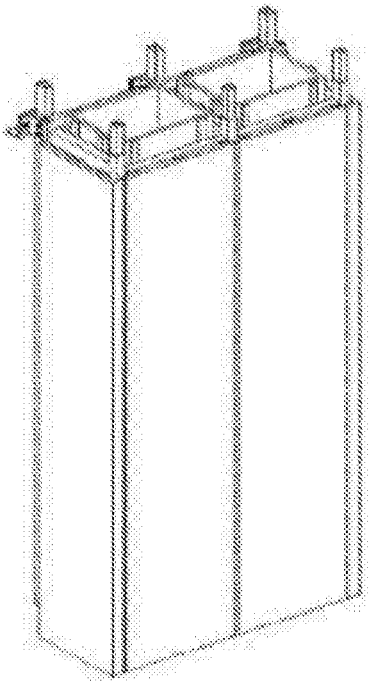
FIG. 21*a* is a schematic diagram of a front surface of a flue external wall plate.
Figure 21B:
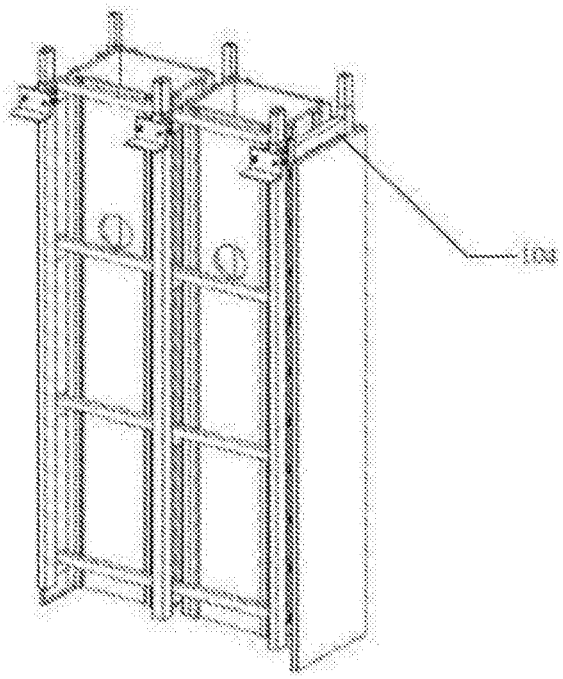
FIG. 21*b* is a schematic diagram of a back surface of the flue external wall plate.
Figure 22A:
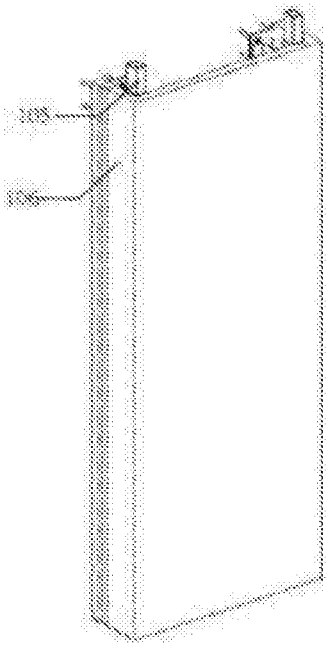
FIG. 22*a* is a schematic diagram of a front surface of a pipeline corridor external wall plate.
Figure 22B:
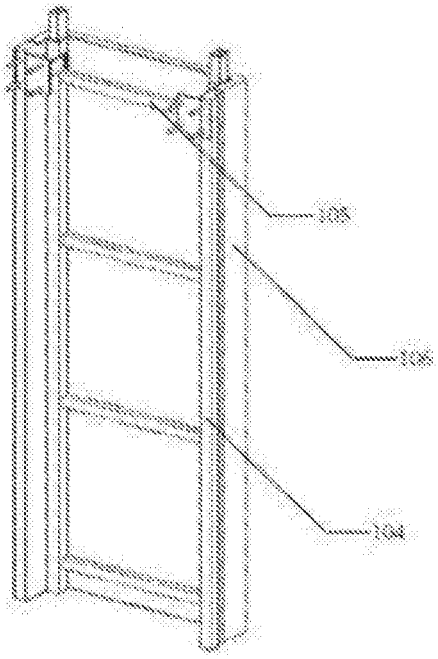
FIG. 22*b* is a schematic diagram of a back surface of the pipeline corridor external wall plate.
Figure 23:
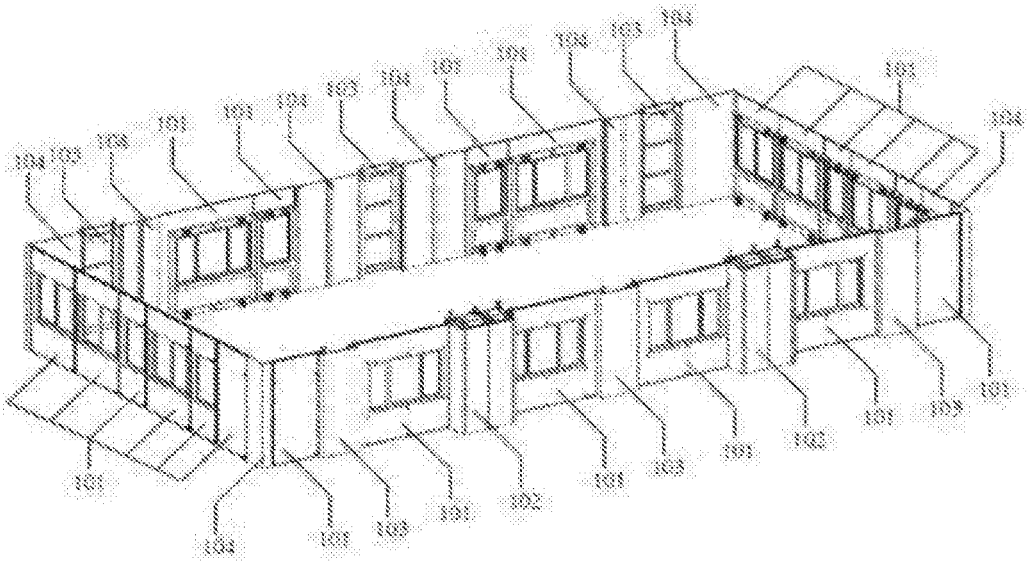
FIG. 23 is a schematic diagram of a completed freestanding combined external envelope system.
Figure 24:
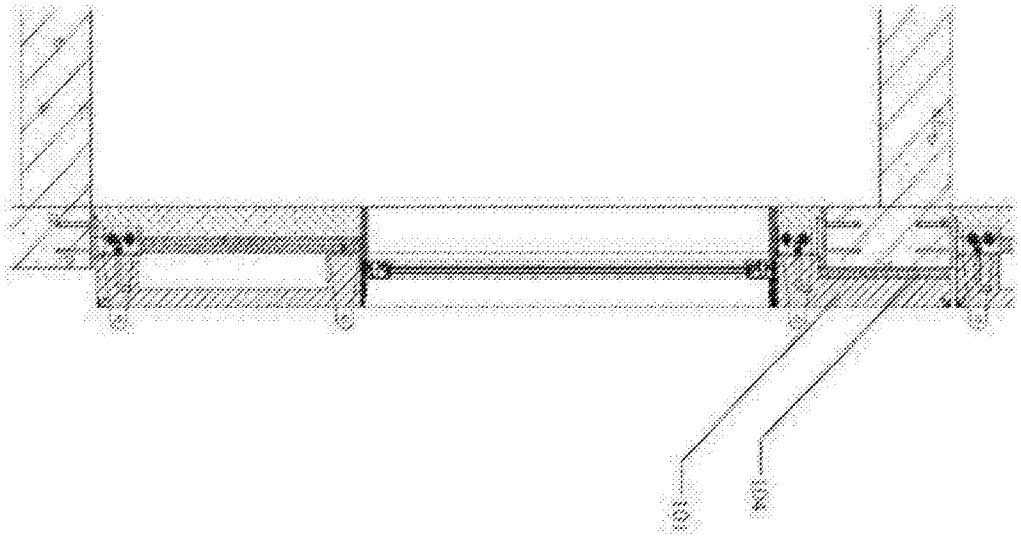
FIG. 24 is a diagram of connecting nodes between a concrete external wall plate and a building structure.

In the figures: 1 refers to pre prefabricated edge constraint member, 2 refers to reinforcement mesh, 3 refers to dismantle free mould, 4 refers to horizontal stirrup, 5 refers to reinforcement member, 6 refers to bottom mould, 7 refers to reinforcement truss, 8 refers to external stirrup, 11 refers to sleeve, 12 refers to preassembled movable reinforcement bar, 61 refers to longitudinal bearing template, 62 refers to horizontal bearing template, 63 refers to positioning member, 100 refers to concrete external wall plate, 101 refers to flue external wall plate, 102 refers to pipeline corridor external wall plate, 103 refers to curtain wall plate, 104 refers to heat-preservation layer, 105 refers to supporting member, and 106 refers to fastening panel.

DETAILED DESCRIPTION

The present invention will be further described hereinafter in detail with reference to the embodiments and drawings.

The building based on a large-space structure body and a freestanding external envelope structure according to the present invention comprises a structure body composed of a vertical-structure reinforced concrete member, a reinforced concrete girder and a reinforced concrete slab, and a freestanding combined external envelope system externally hung in a periphery of the structure body; and the structure body is made of a prefabricated combined reinforcement cage member poured with concrete, the prefabricated combined reinforcement cage member is combined and assembled by a prefabricated vertical-structure reinforcement cage member, a prefabricated girder reinforcement cage member and a prefabricated slab reinforcement cage member, and the prefabricated vertical-structure reinforcement cage member is a prefabricated shear wall reinforcement cage member or a prefabricated column reinforcement cage member;

The prefabricated shear wall reinforcement cage member is a line-shaped, T-shaped, L-shaped, H-shaped or Z-shaped structure, comprising a plurality of prefabricated edge constraint members 1, a reinforcement mesh 2 connected with the prefabricated edge constraint members 1, and a dismantle free mould arranged outside the reinforcement mesh, each prefabricated edge constraint member 1 is arranged freestandingly, the reinforcement mesh is arranged along a wall surface of the shear wall to encircle and connect all the prefabricated edge constraint members 1 together, and the dismantle free mould 3 is integrally connected with the reinforcement mesh 2 through a positioning and fixing member. A dismantle free mesh mould or a dismantle free template is used as the dismantle free mould 3.

In one embodiment, the prefabricated edge constraint member 1 is formed by connecting a plurality of vertical reinforcing bars with spiral stirrups externally surrounding the plurality of vertical reinforcing bars. In a preferred embodiment, an up-down pitch of the spiral stirrup is 100 mm, a longitudinal bar and the spiral stirrup are integrally welded, a mesh interval of the reinforcement mesh is 200 mm, every three meshes form a group, each group is correspondingly provided with one positioning and fixing member to connect two opposite reinforcement meshes.

In the present invention, both the longitudinal bar and the spiral stirrup of the prefabricated edge constraint member 1, and the reinforcement mesh 2 and the prefabricated edge constraint member 1 can be connected by possible ways like welding, binding, etc. In a specific connecting process, manual welding or binding can be adopted, or a hand-held welder or binder can be used for semi-mechanized assembly.

In the prefabricated shear wall reinforcement cage member according to the present invention, the dismantle free moulds on the outer surface can be connected using the two ways as follows: one way is internal fixing method applicable to the dismantle free mesh mould and the other way is external fixing method applicable to other templates excluding the mesh mould.

In the embodiment of the prefabricated shear wall reinforcement cage member according to the present invention, I-shaped, T-shaped, L-shaped, H-shaped or Z-shaped structures may be adopted. Accordingly, a structure of the prefabricated edge restraining member 1 includes two types.

The members of the T-shaped structure and the H-shaped structure comprise two types of the prefabricated edge constraint members 1, one type of the prefabricated edge constraint member is located at an outer edge of a web member and a flange member, and is a reinforcement member formed by connecting a vertical reinforcing bar with a spiral stirrup, the other type of the prefabricated edge constraint member is located at an intersection area of the web member and the flange member, and is formed by connecting four reinforcement members above through a horizontal stirrup 4, wherein one reinforcement member is located at an intersection and connection area of the web member and the flange member, the remaining three reinforcement members are arranged closely adjacent to three side surfaces of the reinforcement member, two reinforcement members in a web direction are connected together through a horizontal stirrup 4, and three reinforcement members in a flange direction are also connected together through a horizontal stirrup 4.

The members of the L-shaped structure and the Z-shaped structure comprise two following types of the prefabricated edge constraint members 1, one type of the prefabricated edge constraint member is located at an outer edge of the member, and is a reinforcement member formed by connecting a vertical reinforcing bar with a spiral stirrup, the other type of the prefabricated edge constraint member is located at an L-shaped intersection area, and is formed by the three reinforcement members above connected in pairs through the horizontal stirrup 4, wherein one reinforcement member is located at an L-shaped intersection and connection area of the members, and the remaining two reinforcement members are arranged closely adjacent to two side surfaces of the reinforcement member.

The prefabricated column reinforcement cage member according to the present invention comprises a reinforcement member 5 and the dismantle free mould 3 arranged along a column surface of the column. The dismantle free mould 3 is integrally connected with the reinforcement member 5 through a positioning and fixing member. The reinforcement member 5 may be made of steel bars or section steel.

In an embodiment of the prefabricated column reinforcement cage member, a following structure is adopted: only one reinforcement member 5 is arranged, the reinforcement member 5 is a reinforcement member formed by connecting a vertical reinforcing bar with a stirrup, and the dismantle free mould is directly arranged along an outer side of the reinforcement member and is connected with the stirrup through a positioning and fixing member, so that the dismantle free mould is integrally connected with the reinforcement member 5. When using a thick stirrup, the prefabricated column reinforcement cage member can be manufactured by the following reinforcing mesh reinforcement cage member through an integral forming method: connecting the vertical reinforcing bar and the stirrup into a crossed meshy member, and bending the meshy member to make the two ends form a drum-shaped member, thus obtaining the prefabricated column reinforcement cage member.

In another embodiment of the prefabricated column reinforcement cage member, a plurality of reinforcement members are arranged according to the design of the column and a reinforcing requirement, an external stirrup 6 constraining and integrally connecting the plurality of reinforcement members 5 is arranged meanwhile, the reinforcement member 5 is a reinforcement member formed by connecting a vertical reinforcing bar with a stirrup, or a reinforcement member formed by connecting a vertical reinforcing bar with a clamping member, and the dismantle free mould 3 is connected with the external stirrup 6, so that the dismantle free mould 3 is integrally connected with the reinforcement member 5.

Similar to the prefabricated shear wall reinforcement cage member described above, internal fittings of the reinforcement member 5, and the reinforcement member 5 and the external stirrup 6 can be connected by welding, binding and other possible connecting forms. In a specific connecting process, manual welding or binding can be adopted, or a hand-held welder or binder can be used for semi-mechanized assembly.

In the preferred embodiment of arranging a plurality of reinforcement members 5 for the prefabricated column reinforcement cage member, four reinforcement members 5 are arranged at corners of the column, and are integrally connected by the external stirrup 6. Of course, in the solution of the present invention in which the prefabricated column reinforcement cage member is provided with a plurality of reinforcement members 5, it is not limited to this specific embodiment, but further comprises other number of reinforcement members 5 and specific arrangement forms on the premise of conforming to the design of the column and the reinforcing requirement.

The prefabricated girder reinforcement cage member of the present invention comprises a reinforcement member and a dismantle free mould 3 arranged along front and back side surfaces and a bottom surface of the girder. The dismantle free mould 3 is integrally connected with the reinforcement member 5 through a positioning and fixing member, and the reinforcement member 5 is formed by connecting a horizontal reinforcing bar with a stirrup. The prefabricated girder reinforcement cage member in the present invention may either be formed by one reinforcement member 5 or be formed by a plurality of reinforcement members 5. A dismantle free mesh mould or a dismantle free template is used as the dismantle free mould 3, and a connecting rib or an edge frame is used as the positioning and fixing member.

In an embodiment of the present invention, a following structure is adopted in the prefabricated girder reinforcement cage member: only one reinforcement member 5 is arranged, the dismantle free mould is directly arranged along front and back side surfaces and a bottom surface of the girder and integrally connected with a stirrup of the reinforcement member 5. The reinforcement member 5 is formed by connecting a plurality of horizontal reinforcing bars with stirrups externally encircling the plurality of horizontal reinforcing bars. When using a thick stirrup, the prefabricated girder reinforcement cage member can be manufactured by the following reinforcing mesh reinforcement cage member through an integral forming method: connecting the horizontal reinforcing bar and the stirrup into a crossed meshy member, and bending the meshy member to make the two ends form a drum-shaped member, thus obtaining the prefabricated girder reinforcement cage member.

In another embodiment, a plurality of reinforcement members 5 are arranged according to the design of the girder and the reinforcing requirement; and an external stirrup 8 constraining the plurality of reinforcement members 5 is arranged meanwhile, and the dismantle free mould reinforcement member 3 is connected with the external stirrup 8, so that the dismantle free mould 3 is integrally connected with all the reinforcement members 5.

In a preferred embodiment of the present invention, a sleeve 11 is arranged at an edge of the reinforcement member 5, a detachable preassembled movable reinforcement bar 12 is temporarily fixed in the reinforcement member 5, and the preassembled movable reinforcement bar 12 can be inserted into the sleeve 11 along a horizontal direction after being detached, and screwed up through a thread. During the construction of the building, after the prefabricated girder reinforcement cage member is lift into place, the preassembled movable reinforcement bar 12 is connected with the adjacent reinforcement cage member and poured together.

In the present invention, the reinforcement member 5 is formed by connecting a plurality of horizontal reinforcing bars and stirrups externally encircling the plurality of horizontal reinforcing bars. In a preferred embodiment, an up-down pitch of the spiral stirrup is 100 mm, a longitudinal bar and the spiral stirrup are integrally welded, a mesh interval of the dismantle free mould is 200 mm, every 3*3 meshes form a group, each group is correspondingly provided with one positioning and fixing member to connect two opposite dismantle free moulds.

The reinforced concrete girder in the present invention is formed by the prefabricated girder reinforcement cage member above poured with concrete.

An assembly method of the prefabricated girder reinforcement cage member according to the present invention comprises following steps:

1) manufacturing a reinforcement member 5 and a dismantle free mould 3 at a factory;

2) for the prefabricated girder reinforcement cage member provided with one reinforcement member 5 only, directly arranging the dismantle free mould 3 along front and back side surfaces and a bottom surface of the reinforcement member 5 and connecting the dismantle free mould with a stirrup; for the prefabricated girder reinforcement cage member provided with a plurality of reinforcement members 5, distributing and positioning the plurality of reinforcement members 5 according to the design of the girder and a reinforcing requirement, then arranging an external stirrup 8 to constrain and integrally connect all the reinforcement members 5, finally arranging the dismantle free mould 3 along the front and back side surfaces and the bottom surface of the girder, and connecting the dismantle free mould with the external stirrup 8; and 3) integrally connecting the dismantle free moulds at two side surfaces and the bottom surface of the reinforcement member using a positioning and fixing member.

In the present invention, the horizontal reinforcing bar and the stirrup of the reinforcement member 5, and the dismantle free mould 3 and the reinforcement member 5 can be connected by welding, binding and other possible connecting forms. In a specific connecting process, manual welding or binding can be adopted, or a hand-held welder or binder can be used for semi-mechanized assembly.

In the prefabricated girder reinforcement cage member of the present invention, the dismantle free moulds arranged on the two side surfaces and the bottom surface can be connected using the two ways as follows: one way is internal fixing method applicable to the dismantle free mesh mould, and at this moment, the dismantle free mould 3 is a dismantle free mesh mould, and the dismantle free mesh moulds at the two side surfaces and the bottom surface are integrally connected using a mesh mould fixing member; and the other way is external fixing method combined with templates in other forms.

In the preferred embodiment of arranging a plurality of reinforcement members 5 according to the present invention, four reinforcement members 5 are arranged at corners of the girder, and are integrally connected by the external stirrup 8. Of course, in the solution of the present invention in which a plurality of reinforcement members 5 are arranged, it is not limited to this specific embodiment, but further comprises other number of reinforcement members 5 and specific arrangement forms on the premise of conforming to the design of the column and the reinforcing requirement.

The prefabricated slab reinforcement cage member of the present invention comprises a bottom mould 6, and a reinforcement truss 7 installed on an upper side of the bottom mould 6, the bottom mould 6 comprises a plurality of longitudinal bearing templates 61 arranged in parallel, and a plurality of horizontal bearing templates 62 arranged between two adjacent longitudinal bearing templates 61, the longitudinal bearing templates 61 are integrally connected with the horizontal bearing templates 62 at two sides, the reinforcement truss 7 is arranged above the horizontal bearing template 62, all the reinforcement trusses 7 are integrally connected through a reinforcement bar arranged above the longitudinal bearing template 61, and the reinforcement bar and the reinforcement truss 7 are intersected and further integrally connected with the longitudinal bearing template 61. A positioning member 63 is arranged at an intersection area of the longitudinal bearing template 61 and the horizontal bearing template 62, and the reinforcement truss 7 is fixedly connected onto the horizontal bearing template 62 through the positioning member 63.

In a preferred embodiment of the present invention, a sleeve 11 is arranged at an edge of the reinforcement truss 7, a detachable preassembled movable reinforcement bar 12 is temporarily fixed in the reinforcement truss 7, the preassembled movable reinforcement bar 12 can be inserted into the sleeve 11 along a horizontal direction after being detached, and screwed up through a thread. During the construction of the building, after the prefabricated slab reinforcement cage member is lift into place, the preassembled movable reinforcement bar 12 is connected with the reinforcement bars in adjacent shear wall and column and poured together.

In the present invention, the longitudinal bearing template 61 can be an inverted U-shaped member, and the horizontal bearing template 62 can be a trough member formed by a plate member.

The prefabricated slab reinforcement cage member of the present invention is assembled according to the following method:

1) arranging a plurality of longitudinal bearing templates 61 in parallel, arranging a plurality of horizontal bearing templates 62 between two adjacent longitudinal bearing templates 61, and integrally connecting the longitudinal bearing templates with the horizontal bearing templates 62; and 2) arranging and installing the reinforcement truss 7 above the horizontal bearing template 62, arranging and installing the reinforcement bar above the longitudinal bearing template 61, and integrally connecting the reinforcement truss 7 with the reinforcement bar through a positioning member 63 in a crossed manner, wherein the positioning member integrally 63 connects the reinforcement truss 7 and the reinforcement bar with the longitudinal bearing templates 61 below at the same time.

When the prefabricated slab reinforcement cage member of the invention is used for construction, the following steps are carried out:

1) lifting the above-mentioned prefabricated slab reinforcement cage member to a construction station to install and position;

2) placing a molding filling block on a notch encircled by the longitudinal bearing template 61 and the horizontal bearing template 62 in a bottom mould to install and position, wherein the molding filling block may either be an integrated filling block plays roles of a bottom mould and a side mould together, or an integrated dismantle free template; and a size of the molding filling block is a little bit greater than the notch encircled by the longitudinal bearing template 61 and the horizontal bearing template 62 to facilitate placing and positioning;

3) laying the reinforcement mesh 2 above the reinforcement truss 7 to install and position;

4) pouring concrete in the prefabricated slab reinforcement cage member to maintain and mold, so as to form a ribbed slab;

5) dismounting the bottom mould 6 to final obtain the reinforced concrete slab.

In the present invention, the integrated filling block used may either be an entirely solid filling block, for instance, a solid filling block made of foamed concrete, or a hollow filling block made of sheet material, or an open "filling block" having an external support surface.

In a slab construction method of the present invention, in the case that the adjacent members of the prefabricated slab reinforcement cage member are provided with lugs, the detachable preassembled movable reinforcement bar 12 can be temporarily fixed in the reinforcement truss 7, and after the prefabricated slab reinforcement cage member is lift in place, the prefabricated slab reinforcement cage member 12 is disassembled and used to integrally connect the reinforcement truss 7 with the reinforcing bars in the adjacent members. Of course, in the case that the adjacent members are provided with lugs, there may be another construction solution: instead of preassembled movable reinforcement bar 12 in the reinforcement truss 7, the horizontal reinforcing bars affecting the plate assembly are preset on the side having the lugs (i.e., in the adjacent members but not in the lugs), and after the slab reinforcement cage is in place, the horizontal reinforcing bars will be moved into the lugs in place and integrally connected with the reinforcement truss 7.

The freestanding combined external envelope system comprises a concrete external wall plate 100, a flue external wall plate 101, a pipeline corridor external wall plate 102 and a curtain wall plate 103 arranged along a periphery of the building and connected mutually, the flue external wall plate 101 is correspondingly installed and communicated with an exhaust pipeline of each household in the building, the pipeline corridor external wall plate 102 is correspondingly installed and communicated with a rainwater down pipe, an equipment pipe, water supply and drainage pipelines, a power cable pipe, a gas pipe or a signal cable pipe of each household in the building. The concrete external wall plate 100, the flue external wall plate 101, the pipeline corridor external wall plate 102 and the curtain wall plate 103 are all externally hung on the structure body of the building by means of installing and positioning by a connector bolt, and a freestanding or embedded external hanging method can be adopted as the external hanging manner. A plurality of concrete external wall plates 100 on the building are arranged by interval, and the flue external wall plate 101, the pipeline corridor external wall plate 102 or the curtain wall plate 103 is installed between two adjacent concrete external wall plates 100. The concrete external wall plate 100 is provided with a room window or door opening, and peripheral side edges of the concrete external wall plate 100 are wrapped with metal wrapping edges 11 so as to facilitate gluing and sealing at the connections and joints with other external envelope members and improve the durability.

In the external envelope system of the present invention, the flue external wall plate 101 is a box-shaped member internally provided with a through flue, comprising a built-in flue, an outer frame and a panel arranged on the outer frame, the outer frame is formed by connecting supporting rods arranged on a seamed edge of the box-shaped member, and a heat-preservation layer 104 is filled between the built-in flue and the panel. In a preferred embodiment, the supporting rod is a steel tube or angle steel, and the panel is a light sheet material. The pipeline corridor external wall plate 102 comprises a supporting member 105 and a fastening panel 106, the fastening panel 105 and the fastening panel 106 can be spliced and fastened to form a box-shaped pipeline corridor member encircling external portions of the rainwater down pipe, the equipment pipe, the water supply and drainage pipes, the power cable pipe, the gas pipe or the signal cable pipe, and the heat-preservation layer 104 is arranged inside the fastening panel 106. The supporting member 105 comprises an outer frame and a panel arranged on the outer frame, and the outer frame is formed by connecting supporting rods arranged on a seamed edge. The supporting rod above is a steel tube or angle steel, and both the panel and the fastening panel are light sheet materials.

An embodiment of an assembly method of the freestanding combined external envelope system according to the present invention comprises following steps.

1) An external envelope member is lift to a periphery of the building, and externally hanging and connecting the external envelope member with the structure body of the building through a part of connecting points, wherein a freestanding or embedded external hanging can be used as an external hanging method, two external envelope members are installed by interval, the external envelope member and the structure body are installed and connected by a bolt, and subjected to coarse positioning, and the remaining connecting points reversed are used for subsequent fine positioning. Two concrete external wall plates are installed by interval and subjected to the coarse positioning, which can precisely control a gap between the plates, and provides convenient conditions for fine positioning. The external envelope member is the concrete external wall plate 100, the flue external wall plate 101, the pipeline corridor external wall plate 102 or the curtain wall plate 103.

2) The remaining external envelope members are lift into the interval between two concrete external envelope members finishing coarse positioning to position; after all the external envelope members are lift in place and complete coarse positioning, fine positioning is carried out, and the external envelope member and the structure body are completely connected and installed.

The coarse positioning above is to control a positioning accuracy within 5 cm, and the fine positioning above is to control the positioning accuracy within ±3 mm.

In the present invention, the external envelope member and the structure body of the building are installed and positioned through a connector bolt, which facilitates maintaining, replacing and upgrading the external envelope member within the full life cycle of the building while improving the installing efficiency, and reducing the assembly and construction difficulty.

The preferred embodiment and the most common way of the assembly method of the above-mentioned freestanding combined external envelope system according to the present invention is to firstly arrange and install the concrete external wall plates 100 by intervals in step 1) and carry out coarse positioning, and then to lift and install other types of external envelope members after finishing the fine positioning of the concrete external wall plates 100. In this way, the concrete external wall plates (heavy plates) which are difficult to install and position are lift firstly, and then the light plates (the flue external wall plate, the pipeline corridor external wall plate and the curtain wall plate) are lift and installed, so that the gaps can be accurately controlled, the installation accuracy and efficiency are improved, the construction organization and deployment are facilitated, the installation difficulty is reduced, the process simplification and intensification are realized, and waste is avoided.

The descriptions above are merely preferable embodiments of the invention, and it should be noted that those of ordinary skills in the art may make a plurality of improvements and equivalent substitutions without departing from the principle of the invention, and the technical solutions after the improvements and equivalent substitutions made to the claims of the invention shall also fall within the protection scope of the invention.

What is claimed is:

1. A building comprising a structure body and an envelope structure, wherein the structure body is installed inside of the envelope structure, the structure body comprises multiple units; the structure body comprises a vertical-structure reinforced concrete member, a reinforced concrete girder and a reinforced concrete slab, and a freestanding combined external envelope system externally hung in a periphery of the structure body; and the structure body is made of a prefabricated combined reinforcement cage member poured with concrete, the prefabricated combined reinforcement cage member is combined and assembled by a prefabricated vertical-structure reinforcement cage member, a prefabricated girder reinforcement cage member and a prefabricated slab reinforcement cage member, and the prefabricated vertical-structure reinforcement cage member is a prefabricated shear wall reinforcement cage member or a prefabricated column reinforcement cage member;

the prefabricated shear wall reinforcement cage member comprises a plurality of prefabricated edge constraint members (1), a reinforcement mesh (2) connected with the prefabricated edge constraint members (1), and a dismantle free mould (3) arranged outside the reinforcement mesh (2), the reinforcement mesh (2) is arranged along a wall surface of the shear wall to encircle and connect all the prefabricated edge constraint members (1) together, and the dismantle free mould (3) is integrally connected with the reinforcement mesh (2) through a positioning and fixing member; wherein the dismantle free mould (3) is a kind of mould comprising a seamless metal mesh reinforced with integral ribs;

the prefabricated column reinforcement cage member comprises a reinforcement member (5) and the dismantle free mould (3), the dismantle free mould (3) is arranged along a column surface of the column to encircle the reinforcement member (5) and integrally connected therewith;

the prefabricated girder reinforcement cage member comprises the reinforcement member (5) and the dismantle free mould (3), the reinforcement member (5) is formed by connecting a horizontal reinforcing bar with a stirrup, the dismantle free mould (3) is arranged along front and back side surfaces and a bottom surface of the girder to encircle the reinforcement member (5) and integrally connected therewith;

the prefabricated slab reinforcement cage member comprises a bottom mould (6), and a reinforcement truss (7) installed on an upper side of the bottom mould (6), the bottom mould (6) comprises a plurality of longitudinal bearing templates (61) arranged in parallel, and a plurality of horizontal bearing templates (62) arranged between two adjacent longitudinal bearing templates (61), the longitudinal bearing templates (61) are integrally connected with the horizontal bearing templates (62) at two sides, the reinforcement truss (7) is arranged above the horizontal bearing template (62), the reinforcement truss (7) is integrally connected through a reinforcement bar arranged above the longitudinal bearing template (61), and the reinforcement bar and the reinforcement truss (7) are connected and installed with the longitudinal bearing template (61) at the same time; and the envelope structure comprises a concrete external wall plate (100), a flue external wall plate (101), a pipeline corridor external wall plate (102) and a curtain wall plate (103) arranged along a periphery of the building, the flue external wall plate (101) is correspondingly installed and communicated with an exhaust pipeline of each unit in the building, the pipeline corridor external wall plate (102) is correspondingly installed and communicated with a rainwater down pipe, an equipment pipe, water supply and drainage pipelines, a power cable pipe, a gas pipe or a signal cable pipe of each unit in the building, the concrete external wall plate (100), the flue external wall plate (101), the pipeline corridor external wall plate (102) and the curtain wall plate (103) are all externally hung on the structure body of the building by means of installing and positioning by a connector bolt, a plurality of concrete external wall plates (100) on the building are arranged by interval, and the flue external wall plate (101), the pipeline corridor external wall plate (102) or the curtain wall plate (103) is installed between two adjacent concrete external wall plates (100).

2. The building according to claim 1, wherein the prefabricated shear wall reinforcement cage member is a line-shaped, T-shaped, L-shaped, H-shaped or Z-shaped structure, the members of the T-shaped structure and the H-shaped structure comprise two types of the prefabricated edge constraint members (1), one type of the prefabricated edge constraint member is located at an outer edge of a web member and a flange member, and is a reinforcement member formed by connecting a vertical reinforcing bar with a spiral stirrup, the other type of the prefabricated edge constraint member is located at an intersection area of the web member and the flange member, and consists of four reinforcement members above, wherein one reinforcement member is located at an intersection and connection area of the web member and the flange member, the remaining three reinforcement members are arranged closely adjacent to three side surfaces of the reinforcement member, and the four reinforcement members are integrally connected in a web direction and a flange direction through a horizontal stirrup (4) respectively; and the members of the L-shaped structure and the Z-shaped structure comprise two types of the prefabricated edge constraint members (1), one type of the prefabricated edge constraint member is located at an outer edge of the member, and is a reinforcement member formed by connecting a vertical reinforcing bar with a spiral stirrup, the other type of the prefabricated edge constraint member is located at an L-shaped intersection area, and is formed by the three reinforcement members above connected in pairs through the horizontal stirrup (4), wherein one reinforcement member is located at an L-shaped intersection and connection area of the members, and the remaining two reinforcement members are arranged closely adjacent to two side surfaces of the reinforcement member.

3. The building according to claim 1, wherein one of following two structures is used in the prefabricated column reinforcement cage member:

a) only one reinforcement member (5) is arranged, the reinforcement member (5) is a reinforcement member (5) formed by connecting a vertical reinforcing bar with a stirrup, and the dismantle free mould (3) is directly arranged along an outer side of the reinforcement member (5) and is connected with the stirrup through a positioning and fixing member, so that the dismantle free mould (3) is integrally connected with the reinforcement member (5); and b) a plurality of reinforcement members (5) are arranged, an external stirrup (8) constraining and integrally connecting the plurality of reinforcement members (5) is arranged meanwhile, the reinforcement member (5) is a reinforcement member formed by connecting a vertical reinforcing bar with a stirrup, or a reinforcement member formed by connecting a vertical reinforcing bar with a clamping member, and the dismantle free mould (3) is arranged along an outer side of the external stirrup (8), and is connected therewith through a positioning and fixing member, so that the dismantle free mould (3) is integrally connected with the reinforcement member (5).

4. The building according to claim 1, wherein one of following two structures is used in the prefabricated column reinforcement cage member:

a) only one reinforcement member (5) is arranged, and the dismantle free mould (3) is directly arranged along the front and back side surfaces and the bottom surface of the reinforcement member (5) and is integrally connected with the stirrup; and b) a plurality of reinforcement members (5) are arranged, an external stirrup (3) constraining and integrally connecting the plurality of reinforcement members (5) is arranged meanwhile, and the dismantle free mould (3) is connected with the external stirrup (3), so that the dismantle free mould (3) is integrally connected with the reinforcement member (5).

5. The building according to claim 1, wherein in the prefabricated slab reinforcement cage member, a positioning member (63) is arranged at an intersection area of the longitudinal bearing template (61) are the horizontal bearing template (62), the reinforcement truss (7) is fixedly connected onto the longitudinal bearing template (61) through the positioning member (63), and the longitudinal bearing templates (61) is a reversely U-shaped plate member.

6. The building according to claim 1, wherein a sleeve (11) is arranged at both an edge of the reinforcement member (5) of the prefabricated girder reinforcement cage member and an edge of the reinforcement truss (7) of the prefabricated slab reinforcement cage member, a detachable preassembled movable reinforcement bar (12) is temporarily fixed in the reinforcement member (5) and the reinforcement truss (7), the preassembled movable reinforcement bar (12) can be inserted into the sleeve (11) along a horizontal direction after being detached, and connected and assembled with other reinforcement cage members.

7. The building according to claim 1, wherein the flue external wall plate (101) is a box-shaped member internally provided with a through flue, comprising a built-in flue, an outer frame and a panel arranged on the outer frame, the outer frame is formed by connecting supporting rods arranged on a seamed edge of the box-shaped member, and a heat-preservation layer (104) is filled between the built-in flue and the panel; and the pipeline corridor external wall plate (102) comprises a supporting member (105) and a fastening panel (106), the fastening panel (106) is fastened outside the supporting member (105) to form a box-shaped pipeline corridor member encircling external portions of the rainwater down pipe, the equipment pipe, the water supply and drainage pipes, the power cable pipe, the gas pipe or the signal cable pipe, and the heat-preservation layer (104) is arranged inside the fastening panel (106).

8. A method for constructing a building, the building comprising a structure body and a envelope structure, the structure body is installed inside of the envelope structure, wherein the method comprises the following steps of:

1) manufacturing a prefabricated edge constraint member (1), a reinforcement mesh (2), a dismantle free mould (3), a reinforcement member (5), a longitudinal bearing template (61), a horizontal bearing template (62), a concrete external wall plate (100), a flue external wall plate (101), a pipeline corridor external wall plate (102) and a curtain wall plate (103) at a factory;

wherein the dismantle free mould (3) is a kind of mould comprising a seamless metal mesh reinforced with integral ribs;

2) respectively assembling a prefabricated vertical-structure reinforcement cage member, a prefabricated girder reinforcement cage member and a prefabricated slab reinforcement cage member, and lifting the prefabricated vertical-structure reinforcement cage member to a construction station to install and position;

3) positioning and installing a girder member supporting apparatus, then lifting the girder reinforcement cage member and arranging the girder reinforcement cage member on the supporting apparatus, and connecting the girder reinforcement cage member with the prefabricated vertical-structure reinforcement cage member at a connected portion;

4) positioning and installing a slab member supporting apparatus, then lifting the slab reinforcement cage member and arranging the slab reinforcement cage member on the supporting apparatus, and respectively connecting the slab reinforcement cage member with the girder reinforcement cage member and the prefabricated vertical-structure reinforcement cage member at a connected portion;

5) placing a molding filling block on a mesh unit encircled by the longitudinal bearing template (61) and the horizontal bearing template (62) in a bottom mould (6) to install and position;

6) laying the reinforcement mesh (2) on a reinforcement truss (7) to install and position;

7) pouring concrete in cavities of the prefabricated vertical-structure reinforcement cage member, the prefabricated girder reinforcement cage member and the prefabricated slab reinforcement cage member to maintain and mold;

8) dismounting the girder member supporting apparatus, the slab member supporting apparatus, and the bottom mould (6) to finally obtain a reinforced concrete structure body;

9) lifting an external envelope member to a periphery of the building, wherein two adjacent external envelope members are arranged by interval and are externally hung and connected with the structure body of the building respectively through a part of connecting points for positioning, and the remaining connecting points reserved are used for subsequent re-positioning of the external envelope members, and the external envelope member is the concrete external wall plate (100), the flue external wall plate (101), the pipeline corridor external wall plate (102) or the curtain wall plate (103); and 10) finely positioning the external envelope member which is coarsely positioned, then lifting the external envelope member into the interval between two adjacent external envelope members to connect and position with the structure body of the building, so as to complete the connection and installation of the external envelope member and the structure body.

9. The method according to claim 8, wherein the prefabricated vertical-structure reinforcement cage member is a prefabricated shear wall reinforcement cage member or a prefabricated column reinforcement cage member, and an assembly method of the prefabricated shear wall reinforcement cage member comprises:

distributing and positioning a plurality of prefabricated edge constraint members (1) according to the design of a shear wall and reinforcing requirements, then arranging the reinforcement mesh (2) along a wall surface of the shear wall, and connecting the reinforcement mesh with each of the prefabricated edge constraint members (1), so as to connect all the prefabricated edge constraint members (1) together; and arranging a dismantle free mould (3) along an outer side of the reinforcement mesh (2), and integrally connecting the dismantle free models (3) opposite at two sides of the member using a positioning and fixing member;

an assembly method of the prefabricated column reinforcement cage member comprises:

distributing and positioning a reinforcement member (5), then arranging the dismantle free mould (3) along a column surface of the column, and integrally connecting the dismantle free mould with the reinforcement member (5): for the prefabricated column reinforcement cage member provided with one reinforcement member (5) only, directly arranging the dismantle free mould (3) along an outer side of the reinforcement member (5) and connecting the dismantle free mould with a stirrup; for the prefabricated column reinforcement cage member provided with a plurality of reinforcement members (5), distributing and positioning the plurality of reinforcement members (5) according to the design of the column and a reinforcing requirement, then arranging an external stirrup (8) to constrain and integrally connect all the reinforcement members (5), finally arranging the dismantle free mould (3) along an outer side of the external stirrup (8), and connecting the dismantle free mould (3) with the external stirrup (8); and integrally connecting the dismantle free moulds (3) opposite at two sides of the member using a positioning and fixing member;

an assembly method of the prefabricated girder reinforcement cage member comprises:

distributing and positioning a reinforcement member (5), then arranging the dismantle free mould (3) along front and back side surfaces and a bottom surface of the girder, and integrally connecting the dismantle free mould with the reinforcement member (5):

for the prefabricated girder reinforcement cage member provided with one reinforcement member (5) only, directly arranging the dismantle free mould (3) along front and back side surfaces and a bottom surface of the reinforcement member (5) and connecting the dismantle free mould with a stirrup; for the prefabricated girder reinforcement cage member provided with a plurality of reinforcement members (5), distributing and positioning the plurality of reinforcement members (5) according to the design of the girder and a reinforcing requirement, then arranging an external stirrup (8) to constrain and integrally connect all the reinforcement members (5), finally arranging the dismantle free mould (3) along the front and back side surfaces and the bottom surface of the girder, and connecting the dismantle free mould (3) with the external stirrup (8); and integrally connecting the dismantle free moulds (3) at two side surfaces and the bottom surface of the member using a positioning and fixing member; and an assembly method of the prefabricated slab reinforcement cage member comprises:

arranging a plurality of longitudinal bearing templates (61) in parallel, arranging a plurality of horizontal bearing templates (62) between two adjacent longitudinal bearing templates (61), and integrally connecting the longitudinal bearing templates (61) with the horizontal bearing templates (62); and arranging and installing the reinforcement truss (7) above the horizontal bearing template (62), arranging and installing the reinforcement bar above the longitudinal bearing template (61), and integrally connecting the reinforcement truss (7) with the reinforcement bar through a positioning member (63) in a crossed manner to form the reinforcement truss (7), wherein the positioning member (63) integrally connects the reinforcement truss (7) and the reinforcement bar with the longitudinal bearing templates (61) below at the same time.

10. The method according to claim 8, wherein the external envelope member and the structure body are installed and positioned through a connector bolt, in step 9), the concrete external wall plates (100) are arranged by interval, then in step 10), the other types of the external envelope members are lifted and installed, the coarse positioning is to control a positioning accuracy within ±5 cm, and the fine positioning is to control the positioning accuracy within ±3 mm.

* * * * *